United States Patent [19]

Isoya

[11] Patent Number: 4,465,643

[45] Date of Patent: Aug. 14, 1984

[54] VARIABLE VENTURI CARBURETOR

[75] Inventor: Yukinori Isoya, Nagoya, Japan

[73] Assignee: Aisan Kogyo Kabushiki Kaisha, Japan

[21] Appl. No.: 482,652

[22] Filed: Apr. 6, 1983

[30] Foreign Application Priority Data

Apr. 22, 1982 [JP] Japan ..... 57-60226[U]

[51] Int. Cl.[3] ..... F02M 9/06

[52] U.S. Cl. ..... 261/44 C; 261/DIG. 38

[58] Field of Search ..... 261/44 C, 44 B, 44 F, 261/DIG. 38

[56] References Cited

U.S. PATENT DOCUMENTS

| | | | |
|---|---|---|---|
| 1,072,492 | 9/1913 | Pierson | 261/DIG. 38 |
| 4,075,296 | 2/1978 | Orsini et al. | 261/DIG. 38 |
| 4,157,367 | 6/1979 | Fuchs | 261/DIG. 38 |
| 4,302,405 | 11/1981 | Inoue et al. | 261/44 C |
| 4,371,479 | 2/1983 | Nakamura et al. | 261/44 C |

FOREIGN PATENT DOCUMENTS

| | | | |
|---|---|---|---|
| 700026 | 12/1930 | France | 261/44 B |
| 234422 | 2/1945 | Switzerland | 261/44 B |

*Primary Examiner*—Tim R. Miles

*Attorney, Agent, or Firm*—John E. Benoit

[57] ABSTRACT

Disclosed herein is a variable venturi carburetor for an internal combustion engine in an automobile comprising an air passage provided in the suction piston for communicating the inlet of the air intake passage with the base portion of the fuel metering needle and an air discharge portion provided in the fuel metering needle for communicating the air passage with the venturi portion.

5 Claims, 9 Drawing Figures

VARIABLE VENTURI CARBURETOR

BACKGROUND OF THE INVENTION

This invention relates to a variable venturi carburetor for an internal combustion engine in an automobile.

In a conventional variable venturi carburetor as shown in FIG. 1, a suction piston 3 is transversely moved with respect to a venturi portion 2*a* in an air intake passage 2 in response to the load conditions of an engine to vary the venturi portion 2*a*. A fuel metering needle 4 is fixed at its base portion to the end of the suction piston 3 and is slidably inserted at its tip portion into a main fuel jet 14 for controlling the opening area of a fuel metering portion of the main fuel jet 14 by reciprocating motion of the suction piston 3 to vary the amount of fuel supplied from the main fuel jet 14 through a main nozzle 5 to the air intake passage 2. Reference numeral 6 designates a throttle valve provided in the air intake passage 2. Reference numerals 7 and 8 are a suction chamber formed in a cylindrical portion 1*a* of the carburetor body 1 and a suction spring disposed in the suction chamber, respectively. An air hole 9 is formed in the vicinity of the inlet of the air intake passage 2, whereby atmospheric air is induced through the hole 9. A suction hole 10 is provided at the right-hand end of the suction piston 3 and is adapted to communicate with the suction chamber 7 and the venturi portion 2*a*. Reference numerals 11, 12 and 13 designate a float chamber, a float and a fuel pipe, respectively. In the prior art carburetor, especially at idle and low-speed engine operations, since the transverse distance between the suction piston 3 and the main nozzle 5 becomes shorter, a part of fuel supplied through the fuel nozzle 5 fails to flow along with the induced air flowing in the air intake passage 2. As a result, fuel atomization at the venturi portion 2*a* is disadvantageously reduced over high-speed engine operation. Consequently, as shown in FIGS. 4A and 5A, fuel is apt to adhere to the fuel metering needle 4 and flow down along the inner surface of the air intake passage 2, thus dripping down toward the throttle valve 6. As a result, the air-fuel ratio of the air-fuel mixture to be sucked into the engine is likely to fluctuate, thereby leading to increased fuel consumption as well as to insufficient purification of exhaust gas.

SUMMARY OF THE INVENTION

Accordingly, it is an object of the present invention to provide a variable venturi carburetor which may facilitate fuel atomization at the venturi portion of the carburetor to prevent fluctuation of air-fuel ratio of air-fuel mixture.

It is another object of the present invention to provide a variable venturi carburetor which may reduce fuel consumption and improve purification of exhaust gas.

According to the present invention, the variable venturi carburetor includes a carburetor body, a float chamber, an air intake passage, a venturi portion provided in the air intake passage, a fuel passage communicating with the float chamber and the venturi portion, a main fuel jet provided in the fuel passage, a suction piston transversely movable with respect to the venturi portion in response to the load conditions of the engine and adapted to be slidably mounted in a cylindrical portion of the carburetor body and a fuel metering needle fixed at its base portion to the end of the suction piston and slidably inserted at its tip portion into the main fuel jet for controlling the opening area of a fuel metering portion of the main fuel jet by reciprocating motion of the suction piston to vary the amount of fuel supplied through the main fuel jet to the air intake passage. The variable venturi carburetor further comprises an air passage provided in the suction piston for communicating the inlet of the air intake passage with the end of the suction piston and an air discharge portion provided in the fuel metering needle for communicating the air passage with the venturi portion. With this arrangement, atomization of the fuel supplied through the fuel passage to the venturi portion may be facilitated by the air discharged from the air discharge opening.

Various general and specific objects, advantages and aspects of the invention will become apparent when reference is made to the following detailed description of the invention considered in conjunction with the related accompanying drawings.

DETAILED DESCRIPTION OF THE PREFERRED EMBODIMENTS

Figure 1:
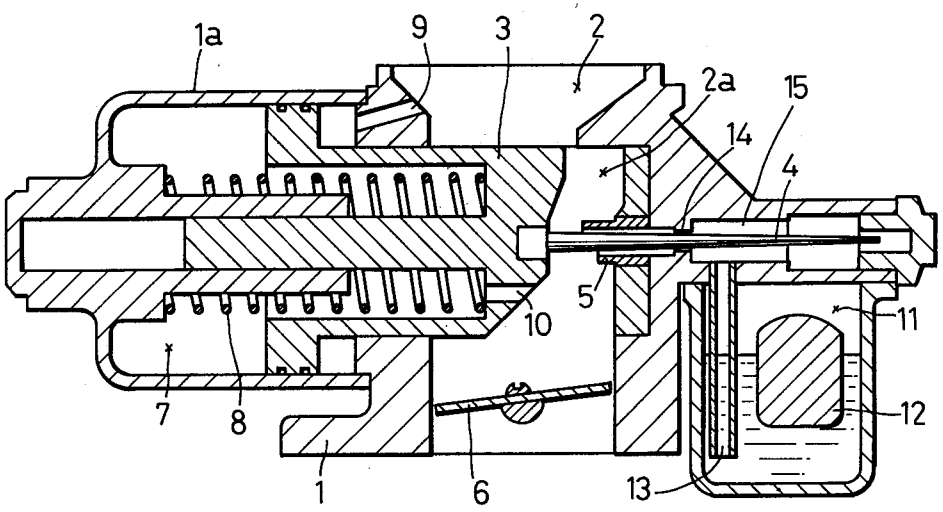
FIG. 1 is a vertical cross-sectional view of a variable venturi carburetor in the prior art.
Figure 2:
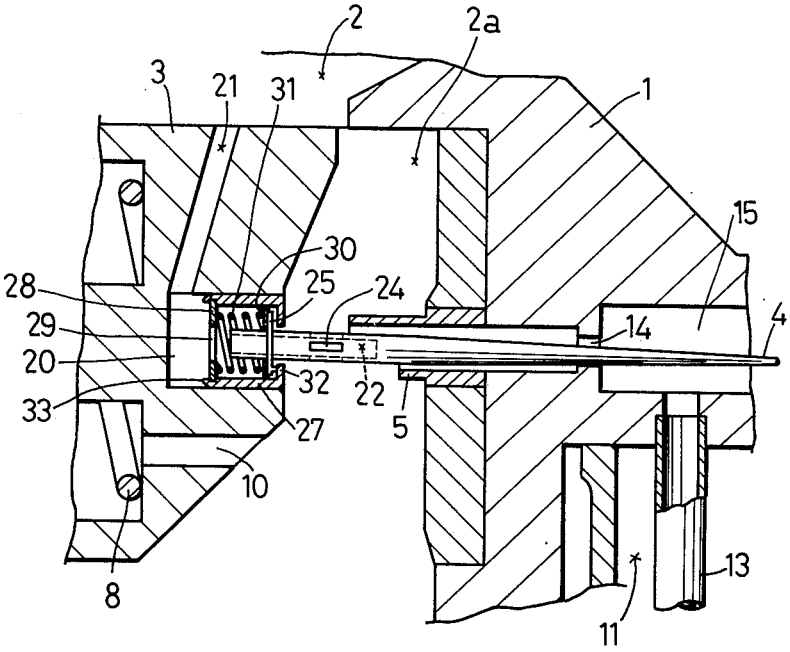
FIG. 2 is a vertical cross-sectional view of the essential part of the variable venturi carburetor of an embodiment according to the invention.
Figure 3:
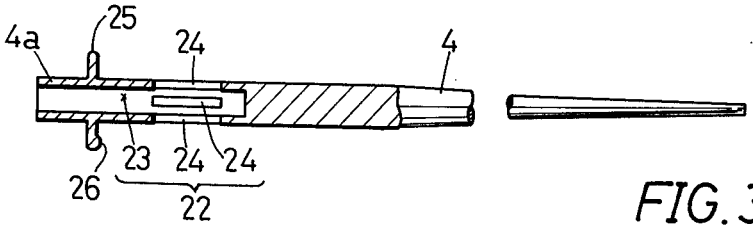
FIG. 3 is a fragmentary cross-sectional veiw of the fuel metering needle in FIG. 2.
Figure 4A:
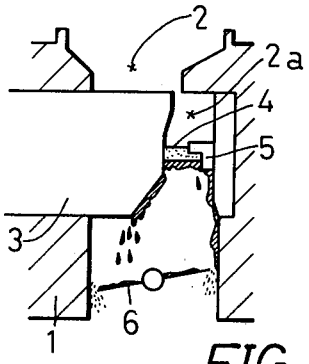
FIGS. 4A and 4B show fuel atomization at engine idling operation in the prior art and the present invention, respectively.
Figure 4B:
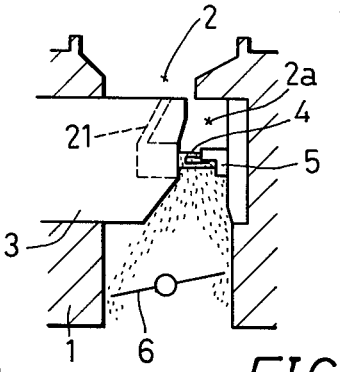
Figure 5A:
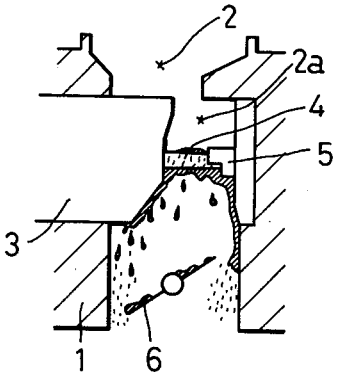
FIGS. 5A and 5B show fuel atomization at low speeds of engine operation in the prior art and the present invention, respectively.
Figure 5B:
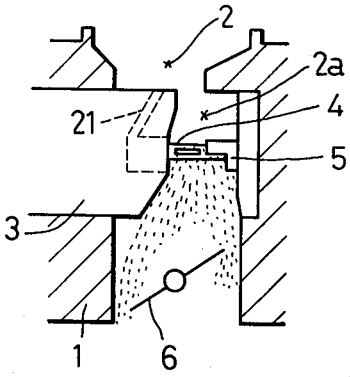
Figure 6A:
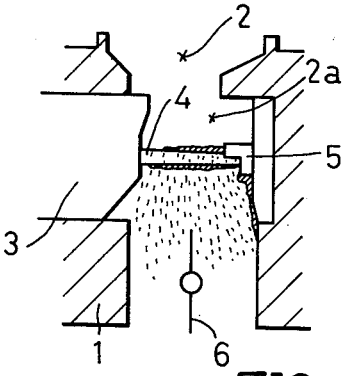
FIGS. 6A and 6B show fuel atomization at high speeds of engine operation in the prior art and the present invention, respectively.
Figure 6B:
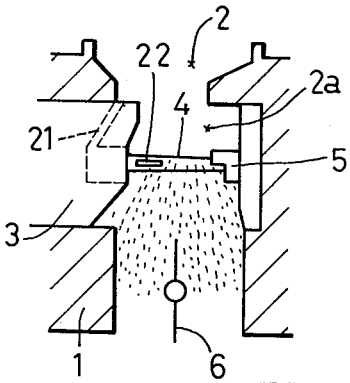

Referring now to FIG. 2 which shows an essential part of the variable venturi carburetor, reference numeral 1 designates a carburetor body having a float chamber 11, an air intake passage 2 and a venturi portion 2*a* provided in the air intake passage 2. Reference numeral 15 designates a fuel passage communicating with the float chamber 11 and the venturi portion 2*a*. The fuel passage 15 is provided with a main fuel jet 14 on the way thereof. Reference numeral 3 designates a suction piston slidably mounted in a cylindrical portion 1*a* of the carburetor body 1 and adapted to reciprocate with respect to the venturi portion 2*a* in response to the load conditions of the engine. The suction piston 3 is provided with a fuel metering needle 4 at its one end. The free end of the fuel metering needle 4 projects into the interior of the main fuel jet 14 for lateral reciprocation therein. Like numerals designate like parts in FIG. 1. There is provided at the right-hand end portion of the suction piston 3 an air passage 21 communicating with an inlet portion of the air intake passage 2 and a bore portion 20 in which the base portion of the fuel metering needle 4 is mounted. As is best seen in FIG. 3, the metering needle 4 is provided with an air communication bore 23 at its base portion 4*a*, and with a plurality of air discharge openings 24 communicating with the air communication bore 23 and the venturi portion 2*a*. The air discharge openings 24 are preferably formed on the outer circumference of the fuel metering needle 4 and arranged equally spaced apart from each other. The air communication bore 23 and the air discharge openings 24 constitute an air discharge portion 22. The base portion 4*a* of the fuel metering needle 4 is formed with a flange 25 on the left-hand side of the air discharge openings 24 as viewed in FIG. 3. The flange 25 includes a projection 26 which projects from the right-hand side surface thereof. Turning specifically to FIG. 2, a casing member 27 is fitted into the bore portion 20 and a ring-like seat member 28 having a through-hole 29 is fixed to the left-hand end of the casing 27 by crimping 33. A spring 31 is accommodated in the casing 27 and is adapted to rightwardly bias the flange 25 through an air sealing member 30 as viewed in FIG. 2. The casing 27 is formed with a stopper 32 for receiving the biasing force of the spring 31 acting on the flange 25. Because of the projection 26 being formed on the right-hand side surface of the flange 25, the fuel metering needle 4 is slidably supported by the inner circumferential surface of the main fuel jet 14. In other words, as viewed in section, the fuel metering needle 4 is eccentric with respect to the circular opening of the main fuel jet 14.

In operation, when air is induced into the air intake passage 2, the induced air partially enters the air passage 21 and flows through the air communication bore 23. Then, the air is discharged from the air discharge openings 24. Upon discharging of the air, liquid fuel delivered from the main nozzle 5, which generally tends to adhere to the metering needle 4, is atomized and diffused into the induced air. As shown in FIGS. 4A to 6B, it is apparent that the carburetor according to the present invention is superior to the carburetor in the prior art in atomizing fuel at idle, low-speed and high-speed engine operations.

The air discharge openings 24 may be formed into round or slit-like shape or any other suitable shapes. The arrangement and the number of the air discharge openings 24 are not limited in the aforementioned embodiment. Furthermore, the metering needle 4 provided with the air discharge portion 22 may be fixedly mounted into the bore portion 20 of the suction piston 3 so as to permit the air discharge portion 22 to communicate with the air passage 21.

While the invention has been described with reference to a specific embodiment, the description is illustrative and is not to be construed as limiting the scope of the invention. Various modifications and changes may occur to those skilled in the art without departing from the spirit and scope of the invention as defined by the appended claims.

What is claimed is:

1. In combination with a variable venturi carburetor for an internal combustion engine in an automobile having a carburetor body, a float chamber, an air intake passage, a venturi portion provided in said air intake passage, a fuel passage communicating with said float chamber and said venturi portion, a main fuel jet provided in said fuel passage, a suction piston transversely movable with respect to said venturi portion in response to the load conditions of the engine and adapted to be slidably mounted in a cylindrical portion of said carburetor body and a fuel metering needle fixed at its base portion to the end of said suction piston and slidably inserted at its tip portion into said main fuel jet for controlling the opening area of a fuel metering portion of said main fuel jet by reciprocating motion of said suction piston to vary the amount of fuel supplied through said main fuel jet to said air intake passage; the improvement comprising an air passage provided in said suction piston for communicating the inlet of said air intake passage with said end of said suction piston and an air discharge portion provided in said fuel metering needle for communicating said air passage with said venturi portion.

2. The variable venturi carburetor as defined in claim 1, wherein said air discharge portion is comprised of an air communication bore provided in said fuel metering needle and a plurality of air discharge openings communicating said air communication bore with said venturi portion.

3. The variable venturi carburetor as defined in claim 2, wherein said air discharge openings extend in the axial direction of said fuel metering needle.

4. The variable venturi carburetor as defined in claim 3, wherein said air discharge openings are of a rectangular shape.

5. The variable venturi carburetor as defined in claim 2, wherein said air discharge openings are formed on the circumference of said fuel metering needle and arranged equally spaced apart from each other.

* * * * *